US005777582A

United States Patent [19]

Raab

[11] Patent Number: 5,777,582

[45] Date of Patent: Jul. 7, 1998

[54] DEPLOYABLE DOUBLE-MEMBRANE SURFACE ANTENNA

[75] Inventor: Anthony Raab, Kanata, Canada

[73] Assignee: CAL Corporation, Ottawa, Canada

[21] Appl. No.: 646,092

[22] Filed: May 7, 1996

[30] Foreign Application Priority Data

May 16, 1995 [CA] Canada ..... 2149492

[51] Int. Cl.[6] ..... H01Q 1/38; H01Q 15/20

[52] U.S. Cl. ..... 343/700 MS; 343/915; 343/846

[58] Field of Search ..... 343/915, 912, 343/914, DIG. 2, 700 MS, 846; H01Q 1/38, 15/20

[56] References Cited

U.S. PATENT DOCUMENTS 3,509,576 4/1970 McLain ..... 343/915
3,631,505 12/1971 Carman ..... 343/915
3,635,547 1/1972 Rushing et al. ..... 343/915

FOREIGN PATENT DOCUMENTS 59-28704 2/1984 Japan ..... 343/915
2120857 12/1983 United Kingdom ..... 343/815

*Primary Examiner*—Hoanganh T. Le
*Attorney, Agent, or Firm*—Pascal & Associates

[57] ABSTRACT

A deployable antenna system comprised of a pair of independently flexible membranes carrying elements of the antenna system, apparatus fixed to corresponding extremity locations of the membranes for stretching the membranes taught and flat, spacers rigidly fixed to corresponding facing locations on the membranes, the locations being selected such that a line passing through each of the spacers is orthogonal to the surface of the membranes when the membranes are stretched, and at another angle to the surface when the membranes are either relaxed or one membrane is shifted laterally to the other.

12 Claims, 9 Drawing Sheets

DEPLOYABLE DOUBLE-MEMBRANE SURFACE ANTENNA

FIELD OF THE INVENTION

This invention relates to a deployable antenna system and more particularly to a double-membrane surface system which achieves a lightweight large surface area and is deployable from a simple canister, suitable for use in planar array antennas employed in earth satellite applications.

BACKGROUND TO THE INVENTION

With the ever increasing demand for more frequency spectrum, it is imperative that greater use be made of the allocated spectrum. This is particularly true in both satellite communications and earth observation by satellite where coverage of service areas by multiple-beam antennas is required, in the case of satellite communications, or where specialised large area antennas are required for synthetic aperture radars, in the case of earth observation. For example, in satellite communications, the use of low cost small satellites is being proposed in order to advance the capability of communications systems by utilizing low earth orbits in which large constellations of low cost satellites are used to provide world wide communications. It is thus necessary to employ low cost antennas with as much complexity in beam switching and steering as cost constraints allow. As another example, in earth observation satellites using synthetic aperture radars, it is often necessary to provide a large deployable antenna with beam switching capabilities in order to effectively map the surface of the earth. Large and versatile planar array antenna structures which can be deployed cheaply and reliably are therefore important for both these applications.

Many such applications employ operating frequencies at and below approximately 1.6 GHz, corresponding to wavelengths of approximately 20 cms and longer. A practical way of achieving large deployable surfaces is by taking advantage of the reduced surface accuracy requirements that such relatively long wavelengths allow. Thus, if a surface accuracy of 1/16 wavelengths is necessary, this corresponds to 1.25 cms root-mean-square accuracy, which for small areas, say 1 meter square, can be readily achieved by conventional deployment techniques, though not in a low cost and lightweight manner. At the longer wavelength of 68 cms, corresponding to a band of the spectrum used for synthetic aperture radars, known as P-Band, such a surface tolerance would be approximately 4 cms. However, the surface area required in such an application might exceed 15 meters square on 225 square meters.

In addition, in both cases mentioned, severe bandwith requirements must be met by the antenna radiating structure. Providing such a structure poses a problem, since the surface must have provision for low cost, lightweight and compatible radiator technology such as patch elements. To meet the bandwidth requirements of both communications and synthetic aperture radar technologies, the patch radiator element must often employ widely separated surfaces. Providing a compactly stowed, reliably deployable, low cost, double membrane surface meeting such a surface tolerance over a very large surface area, for use in space, poses a problem.

Deployable patch antennas are described in U.S. Pat. Nos. 4,547,779, 4,660,048 and 4,843,400. In each case separate layers are spaced by means of a fixed structure, such as a matrix. This type of separation structure is difficult if not impossible to collapse to a minimum space, as is highly desirable if to be used with a satellite.

U.S. Pat. No. 5,124,715 describes a membrane antenna which uses a pair of membranes carrying antenna planes, and a membrane carrying a ground plane between them. The membranes carrying the antenna planes are spaced from the membrane carrying the ground plane by spring loaded fingers fixed to supports carried by the membrane carrying the ground plane. The fingers bend to a position parallel to the membrane carrying the ground plane, thus causing the membranes to rest parallel to each other, and minimizing the space required to stow the membranes when they are rolled onto a drum.

However, rolling the membranes onto a drum requires that the membranes should be taut when rolled, which demands special equipment in an earth gravity environment when preparing the antenna for takeoff, and as well requires an external protective shield prior to deployment.

SUMMARY OF THE INVENTION

The present invention on the other hand provides an antenna system which uses multiple membranes, and which can be stowed inside a canister which protects other service systems of the satellite, in a flexible and, if desired, folded manner. As such, no special equipment is needed to maintain the membranes taut while rolling it for storage around the drum of the membrane, as in the prior art. Further, the structure does not need a special protective shield for the stowed membranes, since the membranes are stowed inside the canister of the satellite.

Briefly, a low cost, lightweight, compactly stowed, reliably deployable, large area, double membrane planar surface antenna system for radiating and receiving electromagnetic waves is achieved by means of a pair of flexible dielectric sheets maintained at a constant separation from each other and with a limited divergence from a planar surface. Each of the flexible dielectric sheets supports a pattern of metallization which permits the efficient distribution and radiation of electromagnetic energy, by the double membrane surface antenna, preferably in two orthogonal linear polarizations. The two sheets in their deployed state are maintained at a constant separation by means of separators of special design. The pair of sheets, which together constitute the double membrane surface, are held taut by means of the deployment booms, four extendible members which are mounted on the host satellite or spacecraft and which are extended to deploy the antenna. The satellite is equipped with a stowage canister into which the double membrane surface is stowed while on the ground ready for deployment after launch into orbit. Once deployed, the double membrane surface is not required to be restowed. However, during ground testing prior to launch the double membrane surface must be repeatedly stowed and deployed and the design of the canister and its extendible deployment mechanism facilitates this.

The canister which is designed for stowage and deployment also contains a rigid central panel on which are mounted the two central beam forming and control networks for the two orthogonal polarizations of the antenna array, as well as such ancillary subsystems for the satellite such as earth sensors, telemetry and command antennas and associated electronics and communications subsystems antenna and electronics, collectively referred herein as service units. The rigid central panel which is also deployed into the plane of the deployed double surface membrane serves these functions as well as providing a fixed location mounting to stabilize the flexible membranes.

In accordance with an embodiment of the invention, a deployable antenna system is comprised of a pair of independently flexible membranes carrying elements of the antenna system, apparatus fixed to corresponding extremity locations of the membranes for stretching the membranes taut and flat, spacers rigidly fixed to corresponding facing locations on the membranes, the locations being selected such that a line passing through each of the spaces is orthogonal to the surfaces of the membranes when the membranes are stretched, and at another angle to the surface when the membranes are either relaxed or one membrane is shifted laterally to the other.

BRIEF INTRODUCTION TO THE DRAWINGS

A more detailed description follows in conjunction with the following drawings wherein:

FIG. 1 shows a large surface area planar array antenna mounted on a satellite structure, FIG. 2A shows a means for maintaining accurate separation of a double membrane surface, FIG. 2B illustrates an alternate means for maintaining accurate separation of a double membrane surface, FIG. 2C illustrate means for maintaining separation of the membranes in a relaxed stated, FIG. 3 is a cross-section through the satellite canister, FIG. 4 is a side view of the antenna in its deployed position, FIG. 5 is a front view of the antenna in its deployed position, FIG. 6 is a front view of the membrane showing the location of ancillary satellite services on a panel in a deployed surface antenna, FIG. 7 is a cross-section of a satellite canister illustrating deployment of an ancillary services panel, FIG. 8 shows a block diagram of the functioning of the antenna system in a synthetic aperture radar system, FIG. 9 is a sketch of a wideband-patch radiating structure with dual linear orthogonal polarization feeding points, FIGS. 10A, 10B and 10C illustrates a microstrip corporate feed network for vertical and horizontal polarization respectively, FIG. 3C being an isometric view of a detail of FIG. 10B, and FIG. 11 shows the operation of beam-forming networks suitable for synthetic aperture radar operation or for a steerable communications beam.

DETAILED DESCRIPTION OF THE PREFERRED EMBODIMENT:

Figure 1:
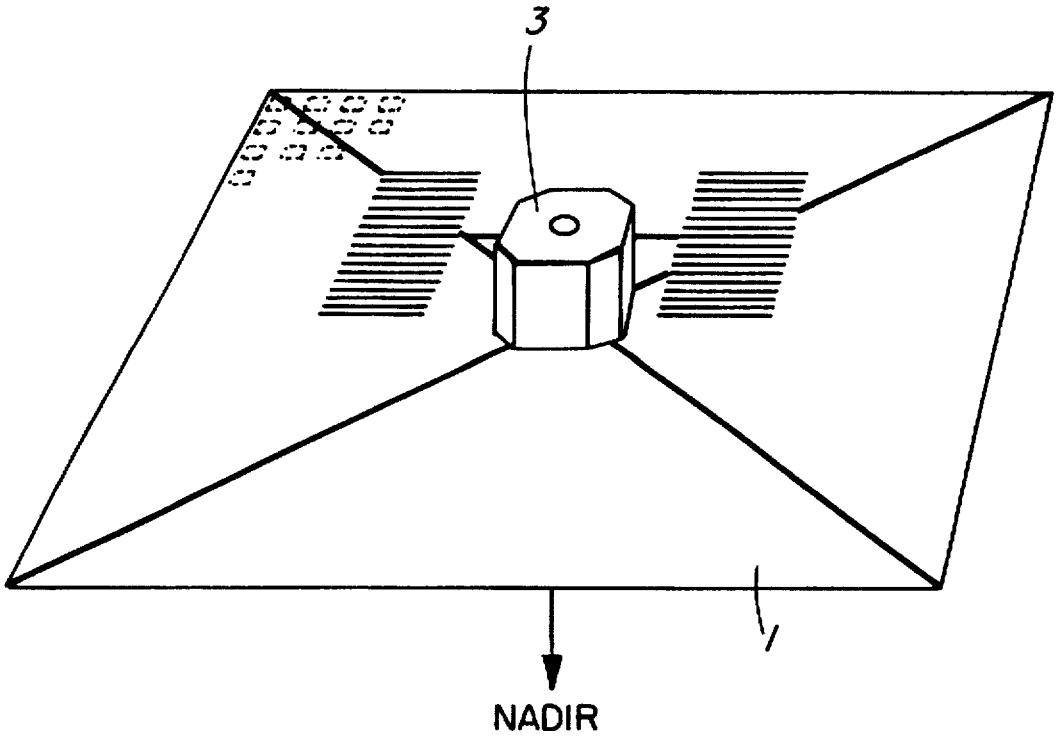

Referring to FIG. 1, a planar array antenna system 1 is shown mounted to a satellite structure 3. The antenna system includes a planar double membrane surface (see FIGS. 2A and 2B) on which patterns of conductive film 6 are laid out in order to serve the requirements for beam forming, distribution and radiation of electromagnetic energy.

The two membranes 5 are kept separate at a constant separation by means of spacing devices, e.g. spacers 7. Spacers are used at a sufficiently small pitch that the surface accuracy is maintained in the areas between the spacers, bearing in mind that the antenna is to be used in the weightless environment of space and that normal gravity-induced sag is not present.

Figure 2A:
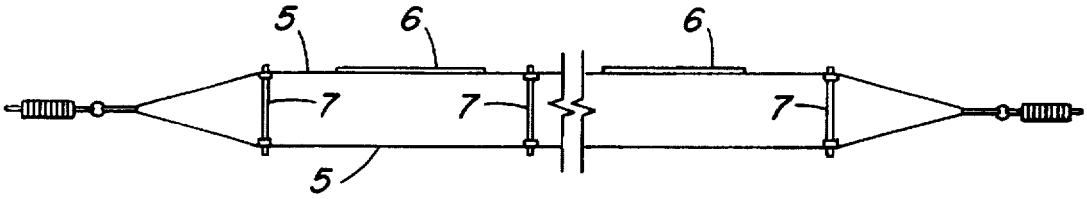
Figure 2B:
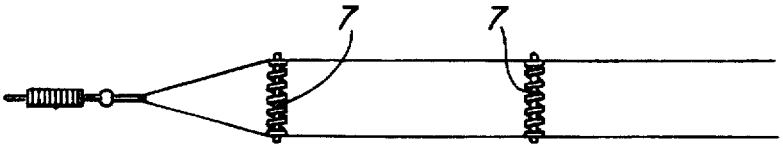
Figure 2C:
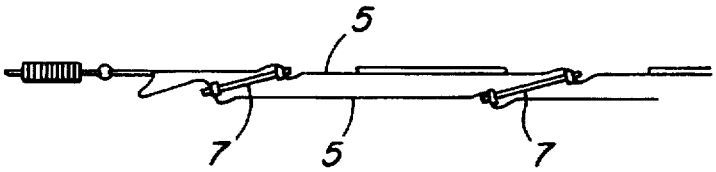

Two different types of spacers are shown in FIGS. 2A and 2B. Both types allow the deployed membranes to be collapsed as shown in FIG. 2C and folded into a small volume suitable for stowing in the stowage canister of satellite structure 3. Both types also allow the membranes to be pulled from the canister by means of extendible deployment mechanisms without fouling and interference occurring between individual spacers.

Referring to FIG. 2B, the spacing device is comprised of a plastic spring, of material transparent to electromagnetic waves both in its material (such as plastic) and by choice of separation between it and an adjacent spacer, and a thin cord of dielectric material of the desired separation length. The spring acts to keep the cord taut, and the membranes separated at the desired separation.

As an alternative, shown in FIG. 2A, the spacing device is comprised of a thin dielectric rod of the desired separation length with thread holes at each end to allow attachment of the rod to the membranes. When the double membrane surface is deployed and tautened, the rods are pulled into an erect position and thereby maintain the required separation.

Figure 3:
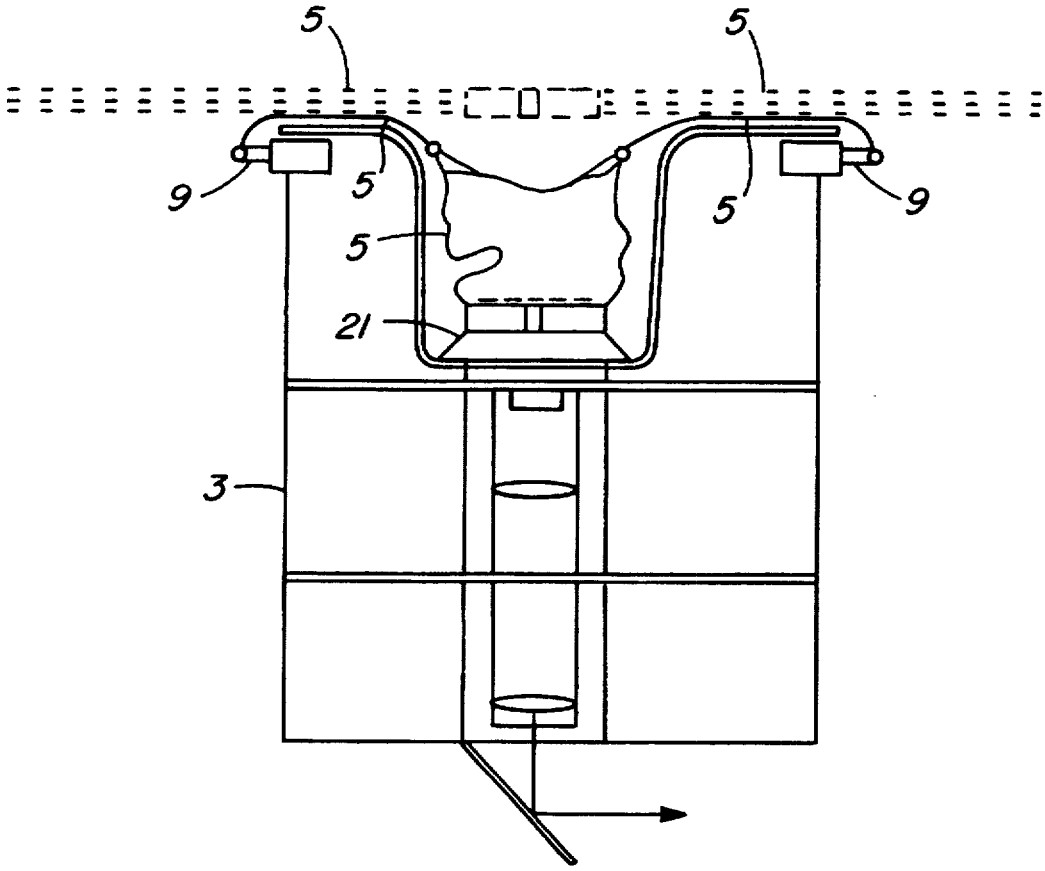
Figure 5:
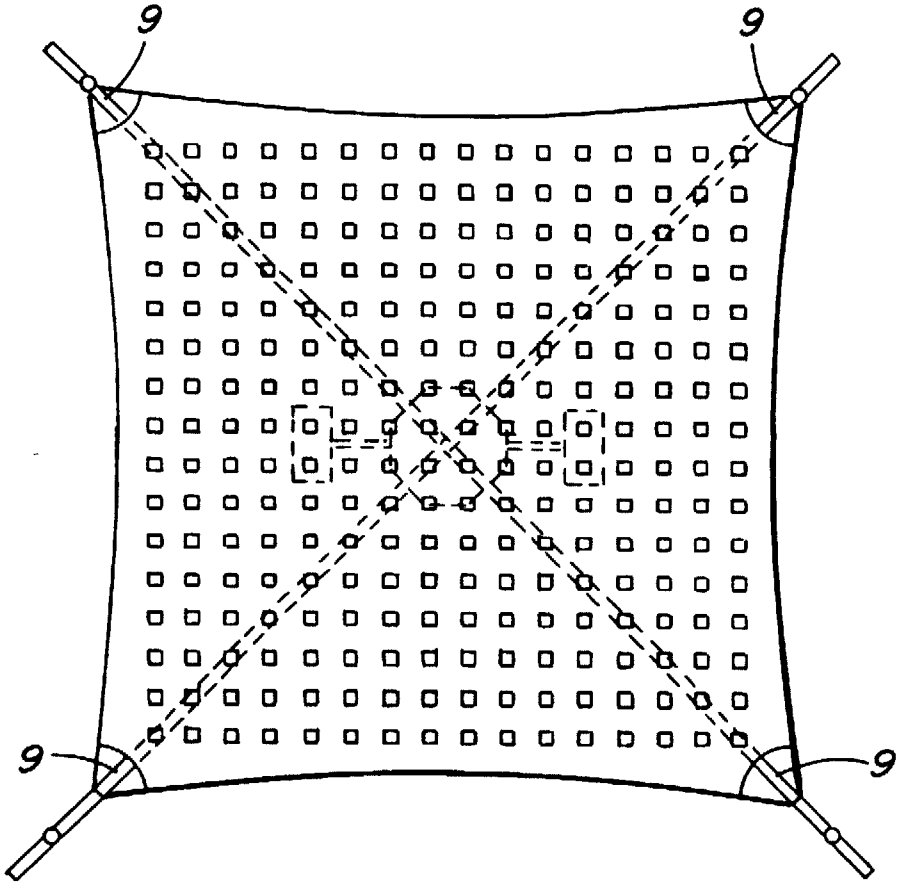
Figure 4:
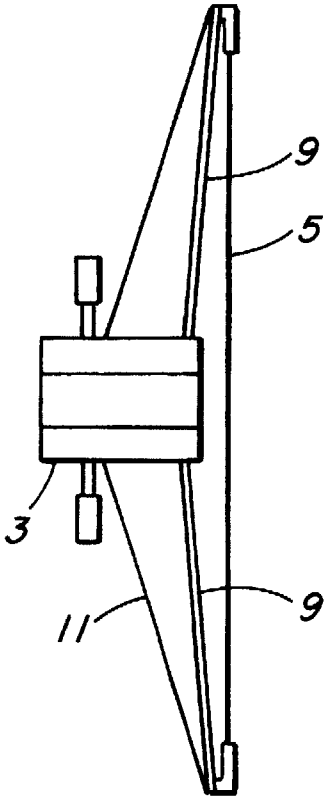

With reference to FIGS. 3, 4 and 5 deployment is achieved by means of four extendible mechanisms 9 such as extendible booms which, being attached to the double membrane adjacent their four corners pull the membranes by their corners from the canister 3 and deploy them until the double membrane is stretched taut. Tautness is preferably achieved by the membrane having a catenary-shaped edge contour as shown in FIG. 5 so that under influence of the extended booms and springs, in its taut position the edges are also taut, thus ensuring minimum stress on the extendible members. It is preferred that the booms should extend slightly forward of the front of the satellite as shown in FIG. 4, the ends being connected by tensioning cables 11 in order to maintain the membranes 5 taut once deployed.

Figure 6:
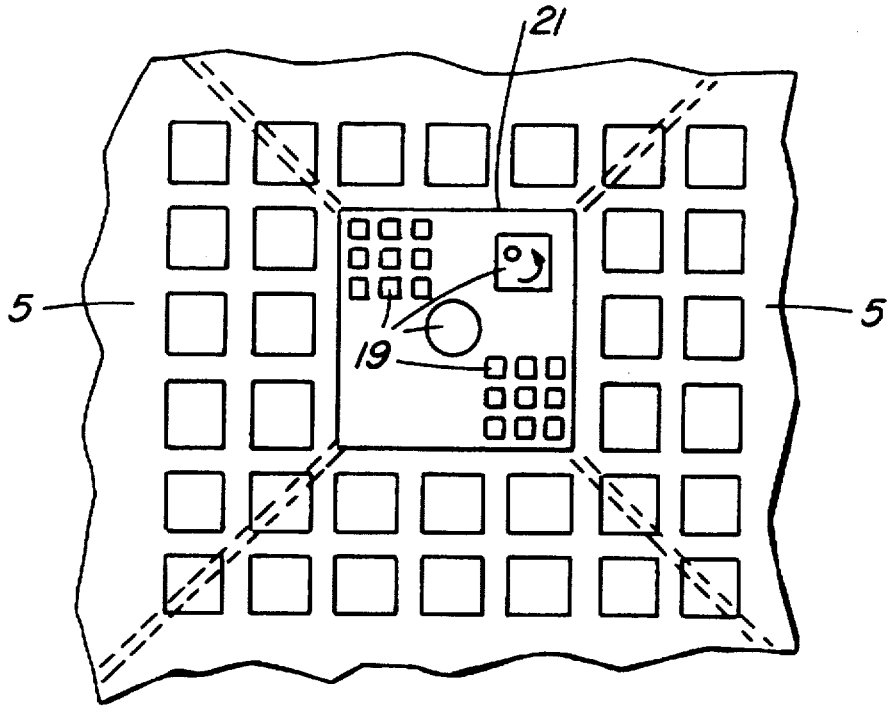

Because the spacecraft must frequently have a clear view of the earth's surface, which is parallel to the deployed double membrane surface, certain ancillary service units should be provided with an unobstructed view of the earth. Such service units are, for example, a telemetry and command antenna, a data link communications antenna, an earth sensor for attitude control, and a viewing port for an optical instrument which might be used on an earth observation satellite. FIG. 6 illustrates these service units 19 which are shown mounted on a rigid panel 21 which is deployed from the satellite along a deployment mechanism 23 (FIG. 7) which places the rigid panel 21 in an appropriate position when the double membrane surface is fully deployed. The attachment of the rigid panel to the mechanism serves also to provide a stabilizing fixed point so that motion induced oscillations of the double membrane surface arising from, say, solar wind or satellite attitude corrections are constrained and reduced. The deployment mechanism can be comprised of wheels 23A running along guide rails 24B.

Figure 7:
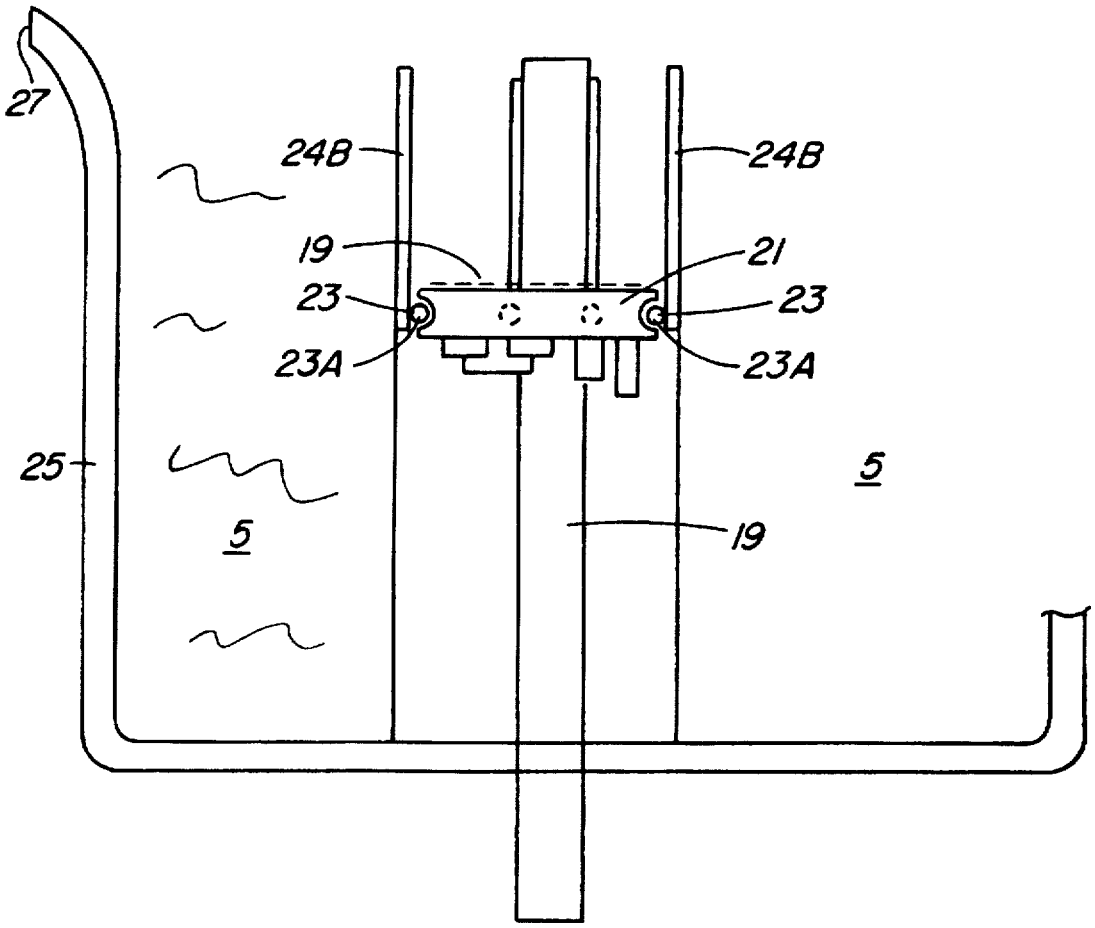

As shown in FIG. 7, in a preferred embodiment, the rigid central panel 21 is stowed centrally, constrained between guide rails 24B, in a stowage canister 25 and the double membrane 5 is stowed in the canister around the rigid panel 21. This ensures that the service units on the rigid panel remain unobscured to the earth view. Stowage of the double membrane surface may be achieved in a number of ways and various folding techniques will suggest themselves to those skilled in the art of folding parachutes.

The canister design illustrated in FIG. 7 includes tapering, rounded edges 27 so that there will be minimum obstruction when the surface is deployed.

Figure 8:
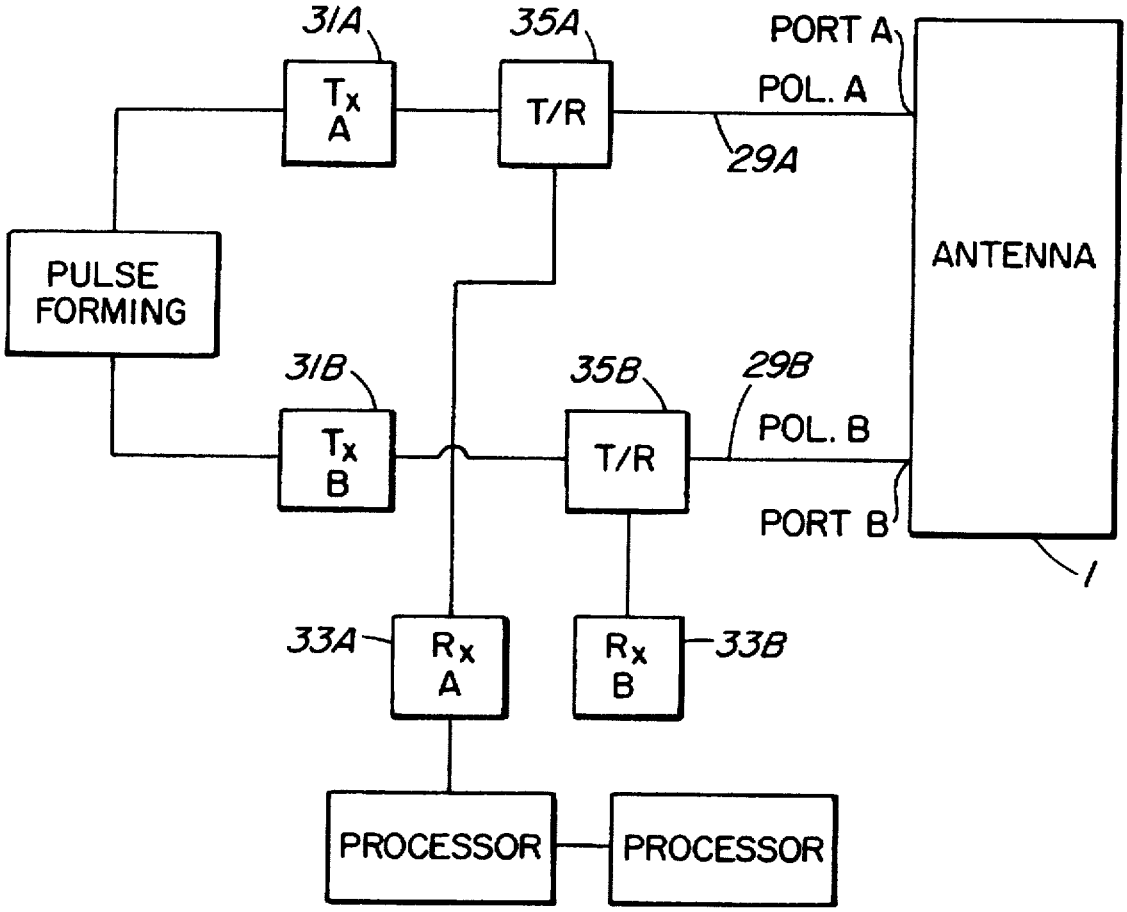

Shown in FIG. 8 is a block diagram of the planar array antenna system 1 which will assist in the understanding of the description of the preferred embodiment. The antenna is comprised of two orthogonally polarized arrays whose common electromagnetic structure consists of an array of radiating elements each of which is equipped with a pair of orthogonally polarized ports, port A and port B. The ports are connected, separately for each polarization, to corporate feeds 29A and 29B which in turn are connected to beam forming networks 31A and 31B. The two corporate feeds 29A and 29B serve the function of distributing electromagnetic energy in a controlled manner. The two beam forming networks connect the transmitter energy to the two corporate feeds in such a manner that the two orthogonally polarized beams radiated from the path elements meet prescribed specifications. The beam forming networks are also connected to two receivers 35A and 33B through diplexing circuitry 35A and 35B. The reciprocity theory of antennas applies in the operation of the antenna structure described herein. Therefore whatever happens in the transmission mode described previously applies in reverse in the reception mode.

Figure 9:
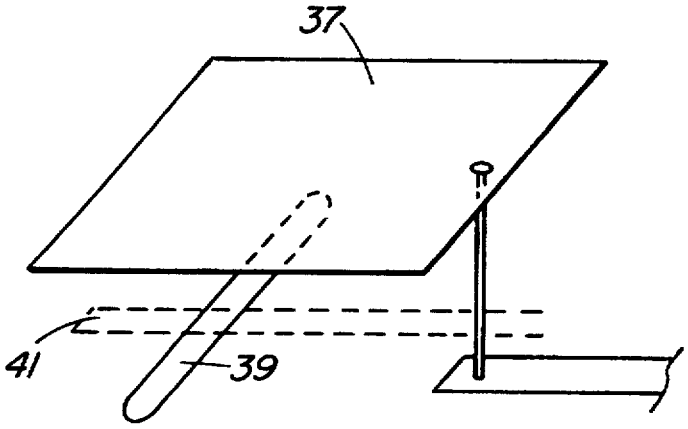

With reference to FIG. 9, the radiating elements 37 which are wideband dual-polarized patch elements, are comprised of the patch itself supported on the upper membrane and an associated excitation cavity which is the open portion of the planar array structure between the two membrane surfaces. The cavity is excited in one linear polarization, here shown coincident with the x-axis of the patch, by a coupling slot 39 located in the ground plane to the patch. The ground plane to the patch is a conducting film laid onto the upper side of the lower membrane, as shown in FIG. 9. The slot itself is excited by the microstrip 5 transmission line 41 which passes under the slot. An orthogonal linear polarization, coincident with the y-axis of the patch as shown in FIG. 9, is excited by means of a directly connected microstrip transmission line on the upper surface of the double membrane.

Figure 10A:
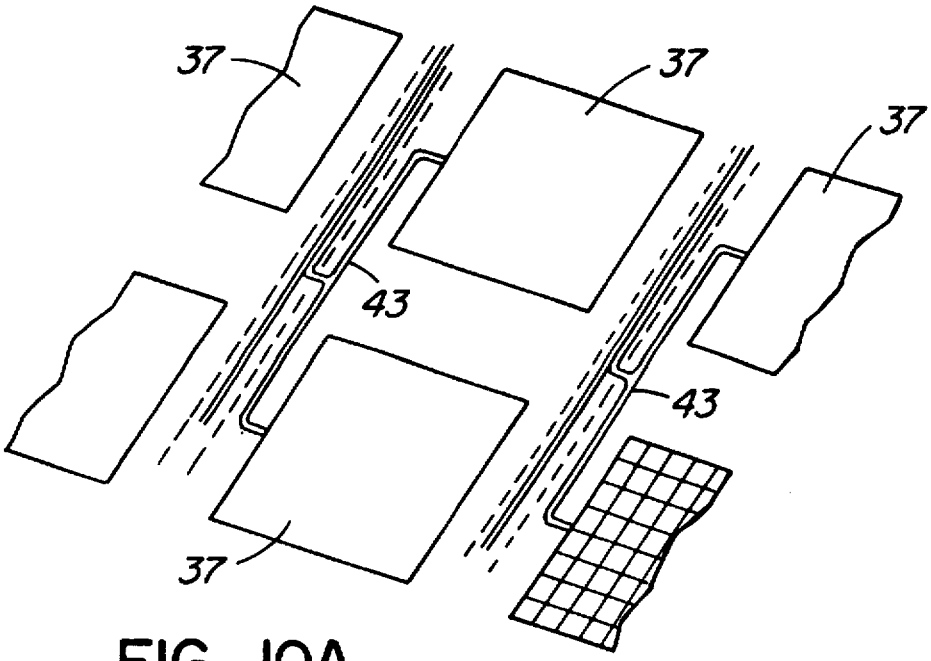
Figure 10B:
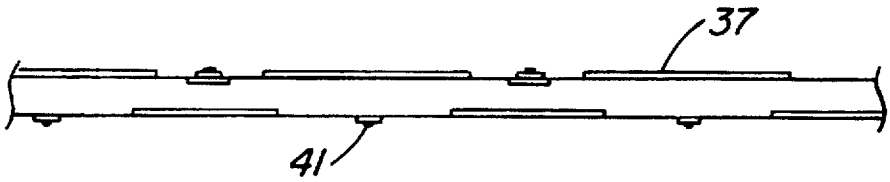
Figure 10C:
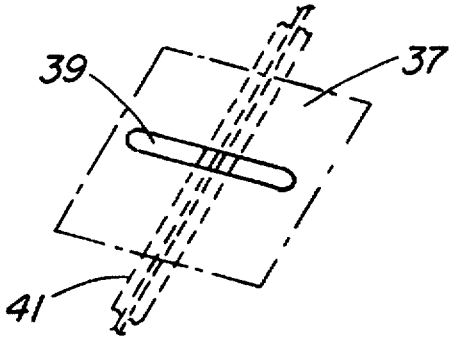

Referring now to FIGS. 10A, 10B and 10C, the individual patch radiating elements 37 are fed by means of separate corporate feeding networks, one (41) for the x-axis polarization, the other (43) for the y-axis polarization. The corporate feeding network for the x-axis polarization ports of the patch array is entirely mounted on the upper membrane while the corporate feeding network for the y-axis polarization ports of the patch array is entirely mounted on the lower membrane.

Figure 11:
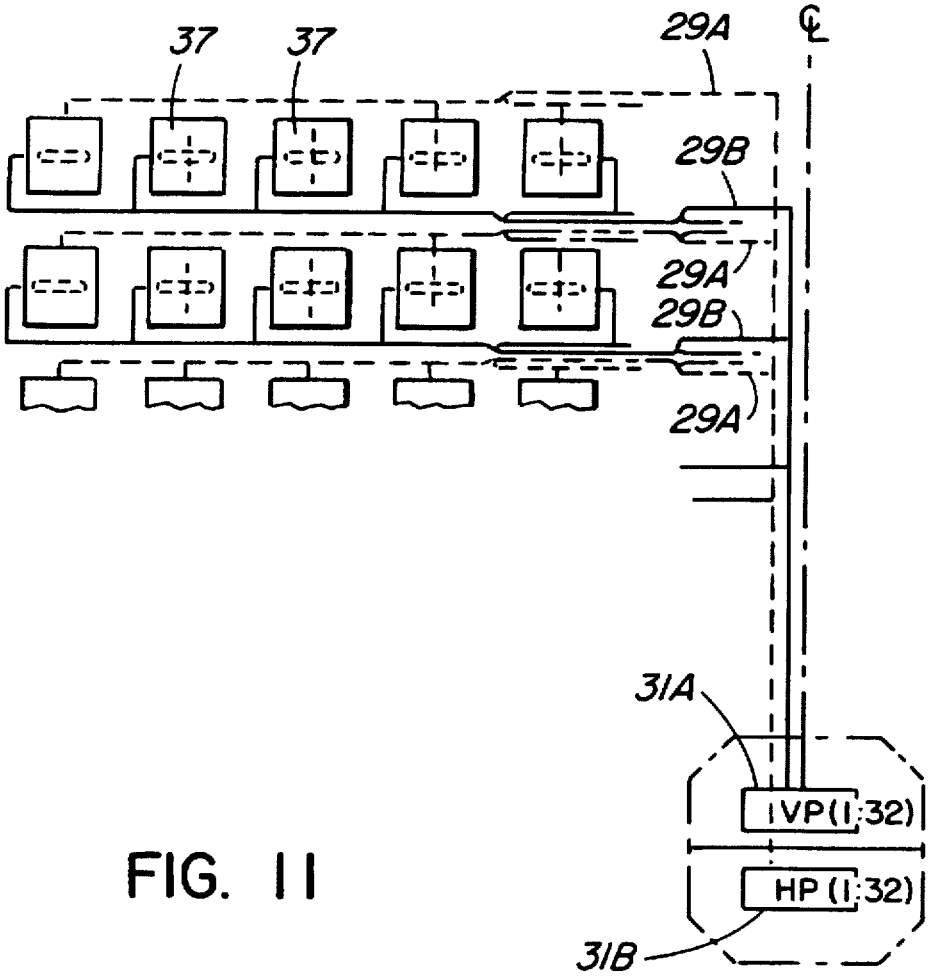

Referring next to FIG. 11, each corporate feeding network 29A, 29B is connected, for the purpose of controlling the radiating properties of the antenna, to a separate centrally-located beam forming network 31A, 31B which distributes electromagnetic energy in a prescribed manner. Each beam forming network may include a number of active devices such as variable phase shifters and variable power dividers to control the electromagnetic energy distributed to the corporate feeding networks.

A person understanding this invention may now conceive of alternative structures and embodiments or variations of the above including applications of the double membrane surface to lens antennae. All of those which fall within the scope of the claims appended hereto are considered to be part of the present invention.

We claim:

1. A deployable double membrane surface planar antenna system having:

(a) a pair of independently flexible membranes carrying elements of the antenna system, comprising an upper membrane provided with radiating patches, a lower membrane uniformly spaced from the upper membrane and forming an excitation cavity between said upper and lower membranes, said lower membrane having a conducting film on the surface thereof proximal said upper membrane, said conducting film forming a around plane, with coupling slots, each slot being excited by a microstrip transmission line positioned on said lower membrane on the side of said lower membrane distal said upper membrane, (b) means fixed to corresponding extremity locations of the membranes for stretching the membranes taught and flat, (c) spacers rigidly fixed to corresponding facing locations on said upper and lower membranes, the locations being selected such that a line passing through each of the spacers is orthogonal to the surface of the membranes when the membranes are stretched, and at another angle to the surface when the membranes are either relaxed or one membrane is shifted laterally to the other.

2. An antenna system as defined in claim 1 wherein said membranes are generally rectangular in shape, and in which the stretching means is comprised of pairs of arms extending between diagonally opposite corners of the pair of membranes, the pair of membranes being fixed to the arms adjacent the ends thereof.

3. An antenna system as defined in claim 2 in which the membranes are fixed to the arms via springs.

4. An antenna system as defined in claim 2 in which each of the arms is extendible outwardly from a central fixed section.

5. An antenna system as defined in claim 4 including a central canister for storage of the membrane with the arms unextended and the membranes collapsed.

6. An antenna system as defined in claim 5 in which the spacers are rods.

7. An antenna system as defined in claim 5 in which the spacers are springs for pushing the membranes apart, and flexible spacing cords for limiting the distance the membranes are pushed apart.

8. An antenna system as defined in claim 1 in which edges of the membranes are catenary in shape, concave inward.

9. An antenna system as defined in claim 1 wherein an upper membrane contains a viewing port, and further comprising an imager carried by at least a lower membrane opposite to the viewing port wherein energy can pass to the imager.

10. An antenna system as defined in claim 9 wherein a portion of the imager extends through the port.

11. An antenna system as defined in claim 1 in which the spacers are rods.

12. An antenna system as defined in claim 1 in which the spacers are springs for pushing the membranes apart, and flexible spacing cords for limiting the distance the membranes are pushed apart.

* * * * *

UNITED STATES PATENT AND TRADEMARK OFFICE

Certificate

Patent No. 5,777,582 Patented: July 7, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Anthony Raab, Kanata, Canada; Geoffre Dobbs, Ontario, Canada.

Signed and Sealed this Sixteenth Day of May, 2000.

DON WONG
*Supervisory Patent Examiner*
Art Unit 2821

UNITED STATES PATENT AND TRADEMARK OFFICE
Certificate

Patent No. 5,777,582 Patented: July 7, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Anthony Raab, Kanata, Canada; and Geoffrey Dobbs, Ontario, Canada.

This Certificate supersedes Certificate issued May 16, 2000.

Signed and Sealed this Twelfth Day of November 2002.

DON WONG
*Supervisory Patent Examiner*
Art Unit 2821